United States Patent [19]

Martin

[11] Patent Number: 4,956,534

[45] Date of Patent: Sep. 11, 1990

[54] INVERTED FRUSTUM SHAPED MICROWAVE HEAT EXCHANGER AND APPLICATIONS THEREOF

[76] Inventor: William A. Martin, 124 Elma-McCleary Rd. #38, Elma, Wash. 98541

[21] Appl. No.: 187,723

[22] Filed: Apr. 29, 1988

[51] Int. Cl.[5] ..... H05B 6/80

[52] U.S. Cl. ..... 219/10.55 A; 219/10.55 R; 219/302; 165/184; 165/901

[58] Field of Search ..... 219/10.55 A, 10.55 F, 219/10.55 E, 10.55 R, 10.55 M, 302, 303; 165/177, 184, 401; 122/247, 249

[56] References Cited

U.S. PATENT DOCUMENTS

| | | | |
|---|---|---|---|
| 1,579,009 | 3/1926 | Langmuir . | |
| 2,442,114 | 5/1948 | Brown . | |
| 3,551,641 | 12/1970 | Truhan | 219/303 |
| 3,788,578 | 12/1973 | Long et al. | 219/10.55 R |
| 4,029,927 | 6/1977 | McMillan | 219/10.55 R |
| 4,114,011 | 9/1978 | Stubbs | 219/10.55 M |
| 4,152,567 | 5/1979 | Mayfield | 219/10.55 A |
| 4,157,700 | 6/1979 | Conner | 219/10.55 AX |
| 4,165,455 | 8/1979 | Mayfield | 219/10.55 A |
| 4;178,494 | 12/1979 | Bottalico et al. | 219/10.55 R |
| 4,236,056 | 11/1980 | Allen et al. | 219/10.55 A |
| 4,284,869 | 8/1981 | Pinkstaff | 219/10.55 A |
| 4,310,738 | 1/1982 | Moretti et al. | 219/10.55 A |
| 4,358,652 | 11/1982 | Kaarup | 219/10.55 A |
| 4,417,116 | 11/1983 | Black | 219/10.55 A |
| 4,751,359 | 6/1988 | Jamieson | 219/10.55A |

FOREIGN PATENT DOCUMENTS

| | | | |
|---|---|---|---|
| 2928520 | 1/1981 | Fed. Rep. of Germany | 219/10.55 R |

*Primary Examiner*—Philip H. Leung

*Attorney, Agent, or Firm*—Saidman, Sterne, Kessler & Goldstein

[57] ABSTRACT

A microwave sourced heat exchanger in an inverted, frusta-pyramidal or frusto-conal shaped configuration. A heat conductive medium is carried within microwave transparent pipes toward a microwave source along a split path of increasing perimeter. The geometrical design of the microwave heat exchanger allows the heat conductive medium anywhere in the conduit to be directly exposed to microwaves. Further, the geometry of the microwave heat exchanger induces a thermal siphon when the heat conductive medium within is exposed to a microwave source placed at the exchanger's broader base. This thermal siphon effect allows for elimination or reduction in size of a circulating motor.

15 Claims, 8 Drawing Sheets

INVERTED FRUSTUM SHAPED MICROWAVE HEAT EXCHANGER AND APPLICATIONS THEREOF

BACKGROUND OF THE INVENTION

1. Field of the Invention

The present invention relates to heat exchangers. In particular, it relates to heat exchangers that make use of microwaves as the energy source.

2. Related Art

In general, heat exchangers are devices used to transfer heat from one heat conductive medium or source to another. The heat supplied from the medium to the heat exchanger may come from a variety of sources, for example, the burning of gas, oil, or coal. Another source of energy is electricity.

One source of energy that has been of interest in recent years is microwave energy. In a typical microwave heat exchanger, microwaves emitted from a microwave source are absorbed by a fluid carried within one or more microwave transparent pipes. The fluid heated by the absorbed microwave energy is then transported to the area to be heated by the fluid. The fluid may be used either to transfer heat indirectly, for example, by convection, or it may be used to directly transfer heat.

One consideration involved in the design of microwave heat exchangers is geometry. In order to allow for the efficient absorption of microwave energy, such heat exchangers are designed so as to allow the heat conductive medium a reasonable amount of exposure to the microwave energy. Representative examples of microwave heat exchanger configurations may be seen in the helical path used in U.S. Pat. No. 3,778,578 (Long et al.) and in the parallel paths used in U.S. Pat. No. 4,417,116 (Black).

The inventor has discovered that conventional microwave heat exchangers suffer from reduced efficiency due to the shadow created by the heat exchange medium (i.e., the fluid or gas within the microwave transparent pipes or conduits). Medium closer to the microwave source absorbs microwave energy and thus "shadows" the medium in the pipes at lower levels (i.e., further from the microwave source). The inventor has discovered that the lack of efficiency created by this "shadow" effect increases energy consumption, and necessitates the use of additional or larger capacity heating equipment. Such shadowing can be readily conceptualized by observing the geometry of parallel path and straight helical (cylindrical) heat exchanger.

Conventional microwave heat exchanges also suffer from another type of shadowing problem. The inventor has discovered that medium carried within any given level of the microwave-transparent pipe or conduit also has a tendency to "shadow" itself. That is, the portion of the medium which is carried closer to the microwave source tends to absorb the majority of the delivered energy. This absorption causes the medium on the side of the conduit closer to the source to become more excited than the medium on the other or farther away side of the same section of conduit.

The inventor believes that efforts to deal with this problem by merely reducing the inner diameter of the microwave transparent conduit frustrates the goal of maintaining the volumetric capacity of the microwave heat exchanger. Further, if parallel conduit sections are used to make up for loss in volumetric capacity, for example, the resulting structure may suffer from problems caused by the shadowing from pipe to pipe.

In order to operate, heat exchangers circulate or move the heat conductive medium from source to destination. In order to accomplish this movement of the medium, conventional microwave heat exchangers often use a mechanical pump. Typically, this mechanical pump is placed along the medium path and may be the only mechanism for circulation of the medium. Any mechanical pump exhibits a certain probability of mechanical breakdown. In addition to increasing hardware costs, such a mechanical pump may increase energy consumption of the system, thus reducing efficiency. A non-pump method of moving the heat conductive medium, that is both efficient and inexpensive, would be desirable.

Microwave heat exchangers may be put to many uses or applications. It is known that microwave energy may be used in hot water heating applications. See, for example, U.S. Pat. No. 4,029,927. In this patent, for example, microwave energy applied to the entire volume of water in the hot water tank. Conventional devices which attempt to heat a large volume of water directly suffer from the deficiency caused by the absorbtion of microwave energy by the water that is close to the microwave source.

SUMMARY OF THE INVENTION

One objective of this invention is to provide a microwave heat exchanger that makes efficient use of microwave energy and is of flexible capacity. Another object of this invention is to provide a microwave heat exchanger that can transport microwave induced heat from source to a destination without the use of a motor if desired. A further object of this invention is to provide a microwave heat exchanger that may be easily used both in residential and commercial heating, cooling and hot-water systems.

The invention comprises a system and method for microwave-sourced heat exchange, which uses a geometrical design calculated to reduce or eliminate "shadow" and to produce medium movement through the inducement of a thermal syphon.

The system makes use of microwave-transparent tubing to lead a heat conductive medium toward a microwave source along a path of increasing perimeter. The shape of the heat exchanger formed by this tubing allows for the direct exposure of the heat conductive medium to microwaves at any distance from the source. The heat exchanger thereby eliminates or reduces the shadow created by the medium carried within the tubing. Further, the shape of the heat exchanger induces a thermal siphon when microwaves are applied to the medium within. This induced thermal siphon may be used to move the heat conductive medium from source to destination without the aid of an in line motor.

In one preferred embodiment, the microwave heat exchanger is configured in the shape of an inverted pyramidal frustum (also referred to as a frusta-pyramid for purposes of this specification). For the purposes of this specification, a pyramidal frusutum or frusta-pyramid is the shape of a section of a pyramid between the base and a plane parallel to the base (i.e. a pyramid with its tip sliced off). A frusta-pyramid will therefore have a broader base, (the original pyramid base), and a narrower base (the base exposed by slicing of off the tip).

In the above-described embodiment, water enters the heat exchanger at its smaller base through a single inlet pipe. As it enters the base of the heat exchanger, the water flow is split into two pipes of a diameter equal to that of the inlet pipe. One pipe leads the water around a rectangular shaped flow path at the base. A second pipe leads the water up and above the first pipe but in a rectangle of slightly wider perimeter. The two microwave-transparent pipes continue around as a pair in this pattern of gradually increasing perimeter with the second water flow path always slightly wider than the first water flow path. The two pipes rejoin at the top or broad base of the heat exchanger. In this embodiment, the path of flow is gradually broadened so as to form a 30° rectangular inverted frusta-pyramid.

The inverted, frusta-pyramidal shape formed by the pipes allows heat exchanger to produce dramatically superior results over known heat exchangers. This is accompanied by optimizing the exposed functional area of the heat exchanger, eliminating the shadow effect from pipe to pipe, eliminating the shadow effect created by the media itself within each pipe, and by utilizing the thermal siphon effect to aid in the flow of the heat conductive media.

When the inverted frusta-pyramidal heat exchanger was used in a hot water heating system, unexpected and superior results were obtained. The heat exchanger was able to provide hot water at over 50% energy savings as compared with conventional hot water heating units. In addition, the heat exchanger was able to heat hot water 20% more efficiently than conventional in line rectangular-serpentine microwave heat exchangers.

The inventors have discovered that the thermal siphon effect induced by the unusual shape of the inventive heat exchanger enables its operation within a residential hot water heating system without a mechanical motor. In cases where a motor is added to increase the flow rate, the thermal siphon effect induced by the heat exchanger provides a significant advantage. The thermal siphon effect enables the heat exchanger to operate using a lower wattage electrical motor than would be practical using serpentine or helical heat exchangers.

Advantageously, the inverted, frusta-pyramidal heat exchanger may be placed within existing hot water, heating and cooling systems with only inexpensive modifications. Due to the efficiency of the heat exchanger, it may be constructed small enough so as to fit inside a conventional microwave oven which may be modified to act as its microwave source. In this embodiment, the inventive heat exchanger is placed broad base up within the microwave oven so as to be oriented coaxially with the center of the oven magnetron or the furnishing aperture of the wave guide which directs the signal into the microwave oven from the magnetron.

In one hot water heating embodiment, the heat exchanger is used as part of a residential/commercial hot water heating system. In this embodiment, the heat exchanger is placed inside a conventional microwave source as described above. Advantageously, a conventional two element hot water tank may be modified for use with the heat exchanger.

It should be understood that the heat exchanger of the present invention may be used in cooperation with any conventional hot water tank. The microwave unit and heat exchanger may be mounted underneath the tank, along its side or in any other position which allows water to flow in the prescribed pattern. The microwave unit should be sealed so that there is no microwave leakage. Such sealing methods are well known in the art.

In a third embodiment the inverted frusta-pyramidal heat exchanger can be used in household or commercial heating applications. In this application, the heat conductive media is circulated through the microwave heat exchanger in a closed path. Along this path the heat conductive medium passes through a conventional copper finned heating coil. Cool air drawn in from the area to be heated is blown through the heating coil by a centrifugal fan and into existing ductwork within the area to be heated. In addition, the flow path is provided with a vented fluid expansion tank which allows the water within the system to expand and contract during operation or inactive periods of the system. Although this particular application is for a forced air type of heating unit, the inventive heat exchanger may just as easily be used in a baseboard heating, steam heating, or hot water heat application.

In a fourth embodiment, the frusta-pyramidal heat exchanger may be used in conjunction with a known ammonia, hydrogen adsorption refrigeration system. In this case, a similar configuration to the one described for the home heating system is used. Instead of going into a heating coil, heat is provided to the ammonia, hydrogen cooling system along the heat conductive mediums circulatory path. In this application, DOWTHERM® heat conductive medium, available from the Dow Chemical Company, is preferably used.

It should be understood that, although the shape of the heat exchanger has been referred to as an inverted frusta-pyramid, the device can be any shape whereby piping causes a heat conductive medium to move from a narrow base to a wide base along paths of increasing perimeter and whereby the angle of climb allows for the exposure of the microwaves to each rung of the spiral. For example, an inverted, conal frustum shape may also be used where the flexibility of the microwave transparent piping material permits. It should also be understood that an optional pump may be placed at either the inlet or the outlet depending on the application.

DETAILED DESCRIPTION OF THE PREFERRED EMBODIMENTS

Table of Contents

I. General Overview
II. Inverted frusta-pyramidal or frusta-conal Heat Exchanger
III. Residential/Commercial Hot Water Heating Embodiment
IV. Residential/Commercial Heating Embodiments
V. Air Conditioning Embodiment
VI. Conclusion

I. General Overview

The detailed description of the preferred embodiments is organized into five separate sections. This first section, the General Overview, contains a short description of each of the preferred embodiments of the pyramidal or conal heat exchanger. Section II contains a detailed description of the inverted, frusta-pyramidal heat exchanger and the alternative frusta-conal heat exchanger without reference to any specific application for the invention. Section III is a description of a residential/commercial hot water heating system using the Inverted, Truncated, Pyramidal or Conal Heat Exchanger. Section IV describes an embodiment using the inventive heat exchanger for residential/commercial heating purposes. Section V is a description of an air conditioning system using the inventive heat exchanger within an ammonia, hydrogen adsorption refrigeration system. Finally, Section VI contains a short conclusion.

II. Inverted frusta-pyramidal or frusta-conal Heat Exchanger

The invention is a system and method for microwave-sourced heat exchange, which uses a geometrical design calculated to reduce or eliminate "shadow" and to produce medium movement through the inducement of a thermal syphon.

The invention makes use of microwave-transparent tubing to lead a heat conductive medium toward a microwave source along a path of increasing perimeter. The shape of the heat exchanger formed by this tubing allows for the direct exposure of the heat conductive medium to microwaves at any distance from the source. The inventive heat exchanger thereby eliminates or reduces the shadow created by the medium carried within the tubing. Further, the shape of the inventive heat exchanger induces a thermal siphon when microwaves are applied to the medium within. This induced thermal siphon may be used to move the heat conductive medium from source to destination without the aid of an in line motor.

Figure 8:
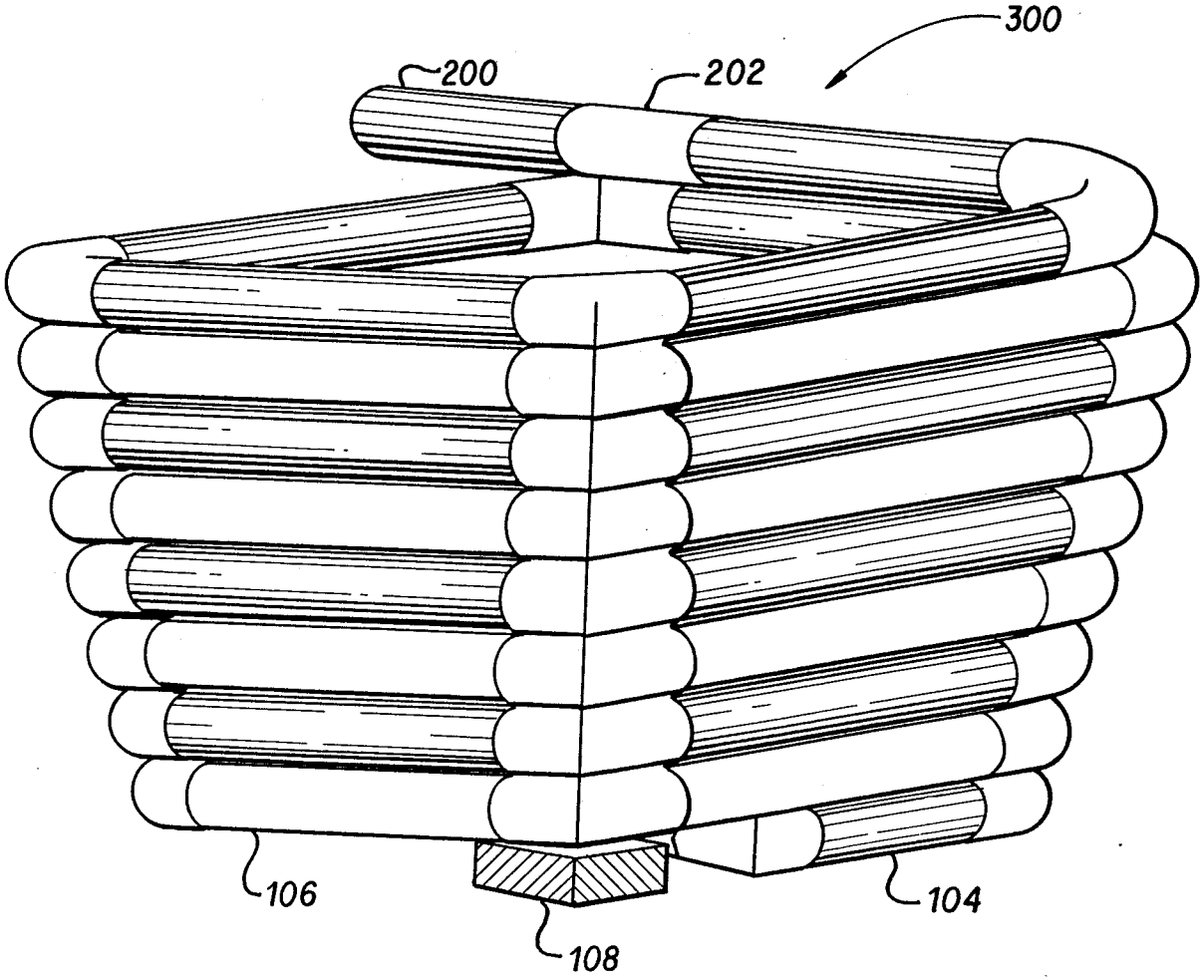
FIG. 8 is a perspective view of the inverted, frusta-pyramidal heat exchanger.

The general shape of the heat exchanger may best be seen by reference to FIG. 8. The inventive heat exchanger (generally referred to by reference numeral 300) is shown in a perspective view. From this view it may be seen that the heat exchanger is in the general shape of an inverted, pyramidal frustum (a frusta-pyramid).

Figure 3:
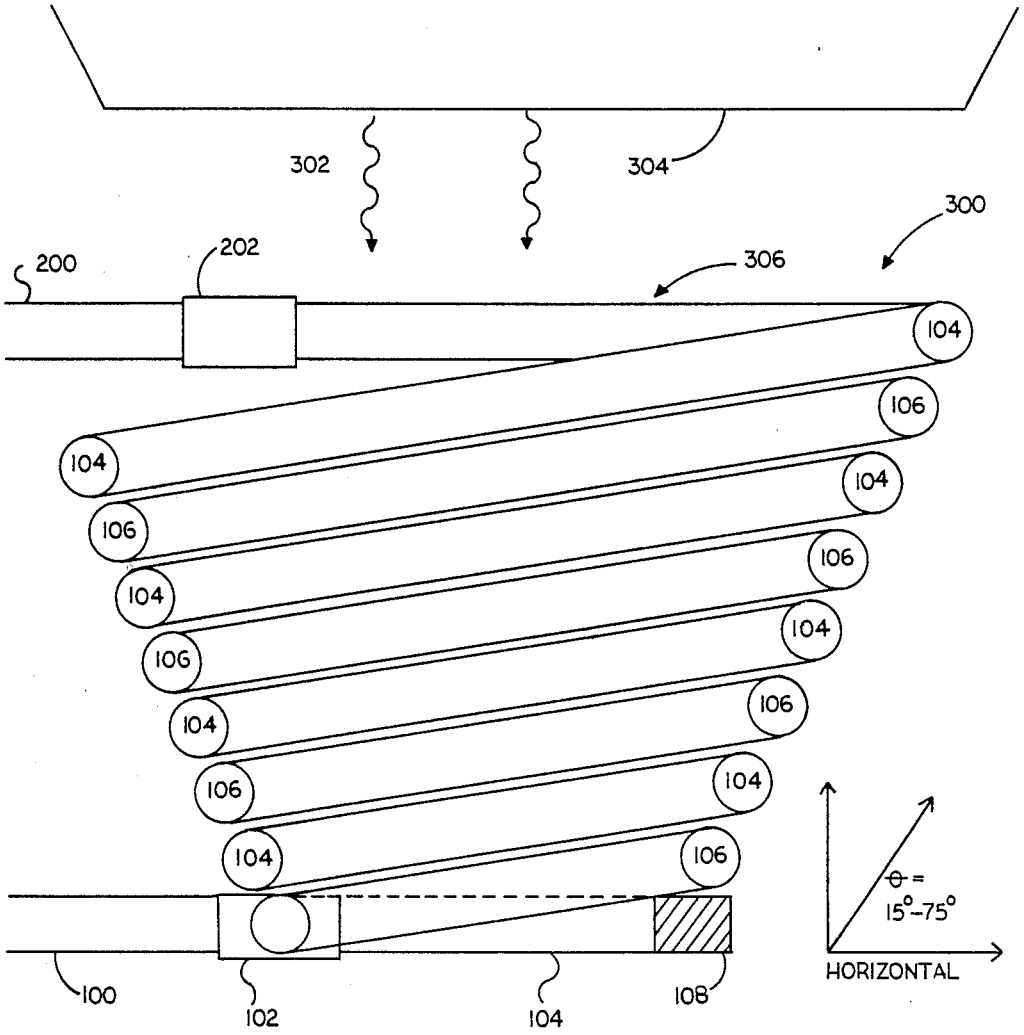
FIG. 3 is a front view of the frusta-pyramidal heat exchanger.

Looking now at FIG. 3, it will be observed that the sides of the heat exchanger angle outwardly at an angle $\theta$ from 15°-75° from the horizontal. It may also be seen from FIG. 3, that while the inventive heat exchanger has one inlet pipe 100 and one outlet pipe 200, the heat exchanger itself is made up of two separate pipes (pipe 104 and pipe 106) which climb as a pair.

In order to form the two separate pipes, (pipe 104 and pipe 106), a single inlet pipe 100 is split into two separate flow paths at the base of the heat exchanger. The split of the single inlet 100 into two pipes may be best seen by reference to FIG. 1. The inlet 100 enters the heat exchanger at the inlet tee 102 where it is split into two separate pipes 104, 106. The first pipe 106 is constructed so as to form a larger perimeter than, and to rest above the second pipe 104. The orientation of the pipes creates the outward angle $\theta$ as seen in FIG. 3.

A first block 108 is used to support the first pipe 106 in its initial ascent above the second pipe 104. A second block 112 is used to support pipe 106 so that it will ascend above the inlet pipe 100. The first and second pipes 106, 104 climb as a pair, (i.e. one above the other), forming progressively larger spirals as they ascend.

From FIG. 8 it will be observed that on any given level from the narrow base of the heat exchanger, the first pipe 106 forms a somewhat larger spiral than the second pipe 104, below it. In an embodiment tested by the inventors, an elbows 110 (see FIG. 1) were used to bend the pipes 104,106 at 90° angles so as to form the spiral shape. It is contemplated by the inventor, however, that all corners and connections may eventually be preformed so as to eliminate the need for elbows and tees.

Figure 2:
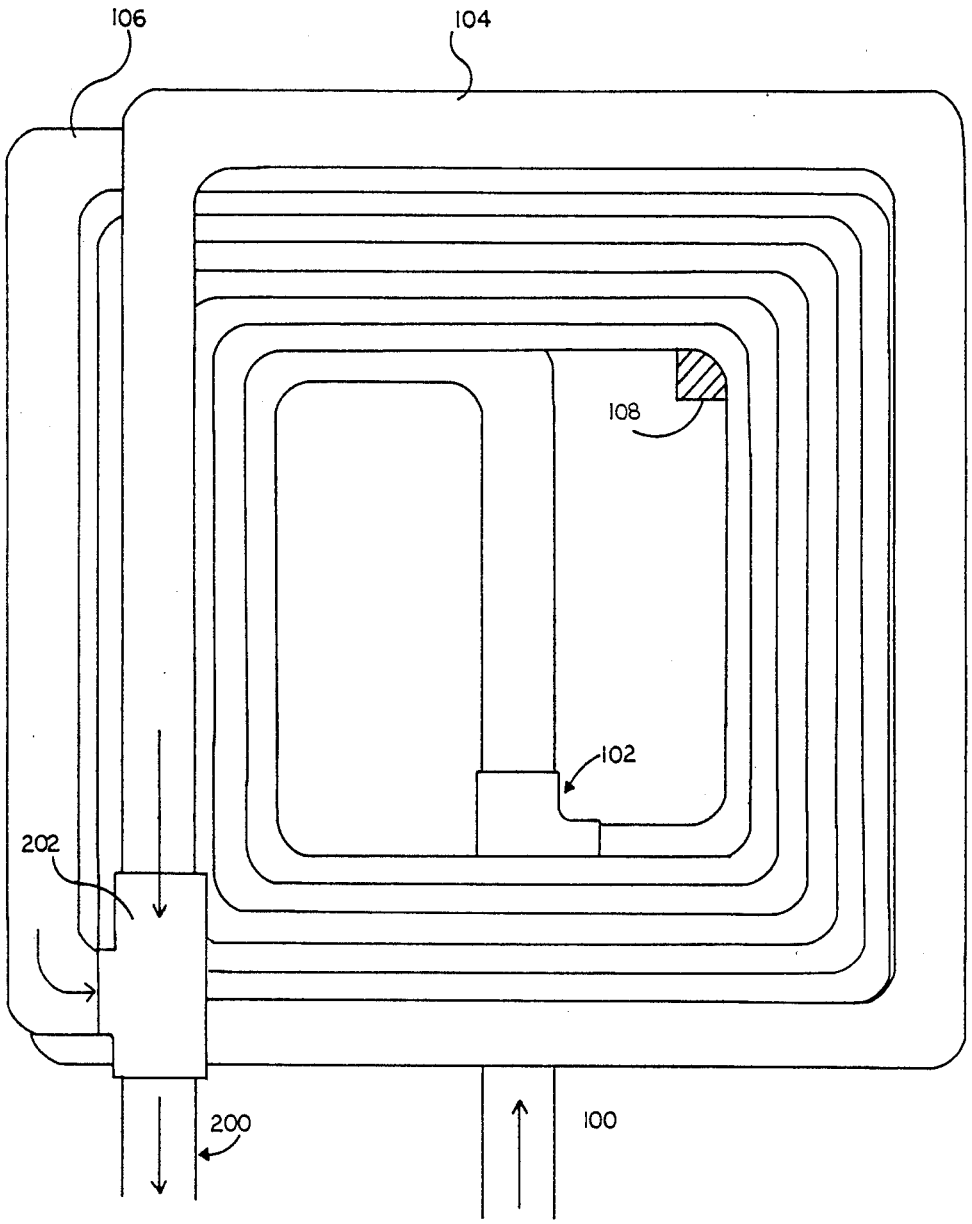
FIG. 2 is a top view of the frusta-pyramidal heat exchanger.

As has been explained, the first and second pipes 106, 104 ascend in a path of increasing spirals. This may be seen more clearly from FIG. 2 which shows a top view of the heat exchanger. When the pipes reach the top, (broader base), of the heat exchanger they are rejoined and formed into a single outlet 200. As may be observed, the first pipe 106 and the second pipe 104 reconnect at the outlet tee 202 so as to form the single outlet 200.

The preferred operation of the heat exchanger will now be described by reference to FIGS. 1 through 5. As may be seen from FIG. 1, heat conductive medium, (represented by arrows), enters the heat exchanger at the inlet pipe 100. When the medium reaches the inlet tee 102 it flow is split into two separate paths. About half of the medium flows through the first pipe 106. The remaining medium flows through the second pipe 104. The medium continues to flow through the pipes in a split path of increasing spirals until it reaches the outlet tee 202. When the medium reaches the outlet tee its flow is recombined into a single flow path. The heat conductive medium then exits the heat exchanger through the outlet pipe 200.

Advantageously, by splitting the flow of the heat conductive medium into two parts and into two pipes which are of the same inner diameter as the single inlet pipe, the depth of the medium penetrated by the microwave energy at each level is increased. This is due to the fact that the heat conductive medium flows more slowly through the exchanger and spends more time at each level. The reduction in the medium's velocity allows for increased efficiency due to the increased time spent under the microwaves emitted from the microwave source. By rejoining the pipes at the broad base of the pyramid, the total volumetric capacity of the heat exchanger remains constant.

Additionally, the split path helps create a greater temperature gradient between alternate flow paths and increases the effectiveness of the exchanger as a thermal siphon. It is this thermal syphon feature which allows for the elimination or reduction in size of the circulating pump found in known heat exchangers. The use of pipes of the same diameter eliminates the increased resistance to flow which might otherwise occur if just one long pipe or thinner piping were used.

The inverted, generally frusta-pyramidal shape of the heat exchanger allows for the efficient use of microwave energy. Again, referring to FIG. 3, the heat exchanger 300 broadens from bottom to top at an angle $\theta$ (15°–75°) and is irradiated with microwaves 302 at its broader base from microwave source 304. This broadening from bottom to top allows for the direct exposure to microwaves of the heat conductive media within each pipe. The result of direct exposure is that the shadow effect is reduced or eliminated. The preferred value for $\theta$ is 30° from horizontal. Experiments have shown that the optimal range for $\theta$ is from 20° to 60° from horizontal (i.e., 30°–70° from vertical). It should be understood that any angled offset from vertical will improve efficiency albeit not as well as the suggested ranges.

Figure 1:
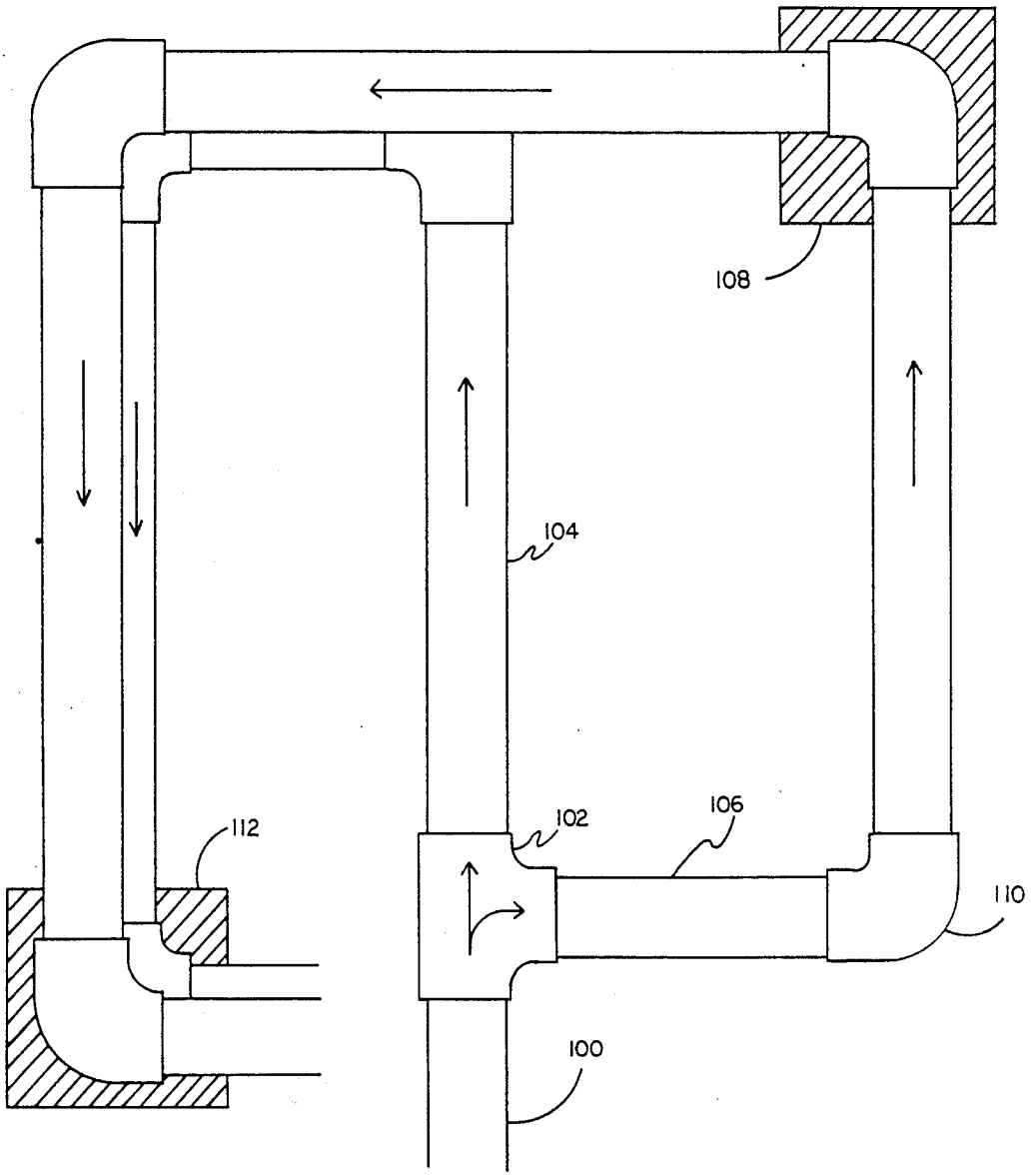
FIG. 1 a top cut-away view of the inverted frusta-pyramidal heat exchanger showing the bottom (narrower) base section.

Advantageously, the broadening form of the heat exchanger also creates a thermal siphon when an active microwave source is placed at the exchanger's broader base. This thermal siphon allows the heat exchanger to operate without the aid of a pump. Heat conductive medium entering the heat exchanger at its narrow base, shown in FIG. 1, is cooler, more dense, and of a lesser volume than the heat conductive medium at each level above the base. As can be observed by reference to FIG. 3, the heat conductive medium at higher levels (i.e., closer to the microwave source 304) will tend to get hotter, and therefore become less dense than the medium below it. As can be seen by reference to FIG. 2, as the first and second pipes 106, 104 approach the upper, or broader base of the heat exchanger 300, they form a widening path. The higher level pipes therefore contain a greater intensity of heat carried in a greater volume of heat conductive medium. This temperature, density, and volume gradient, which creates a thermal siphon effect, tends to move the heat conductive medium from inlet 100 to outlet 200 without the use of a motor.

Figure 4:
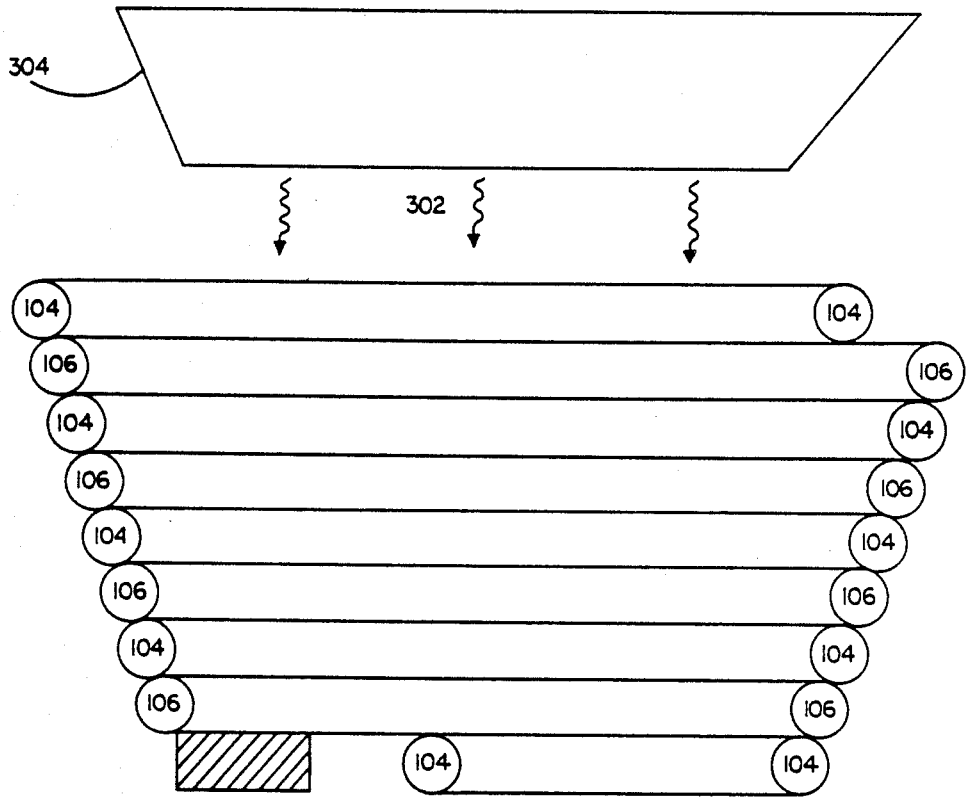
FIG. 4 is a side view of the frusta-pyramidal heat exchanger facing block 108.

As can be seen by reference to FIGS. 3 and 4, the parallel paths on the front and back of the heat exchanger are inclined at a slight angle while the paths on the sides of the heat exchanger do not incline. Advantageously, these alternate inclining and straight paths add to the lift created by the thermal siphon effect by increasing the temperature gradient of the medium between the piping levels. Any angle greater than 8° from horizontal will assist the thermal siphon effect.

Alternatively, a helically wound, inverted conal frustum shape could be utilized in which case the pipes would incline circularly up at each level and would also reap this advantage. In tests conducted by the inventor, an inverted frusta-pyramidal heat exchanger proved capable of heating water about 15% faster than a heat exchanger of an inverted conal type. This can be more easily understood when it is considered that each rung of the preferred frusta-pyramidal heat exchanger is generally in the shape of a square while each rung of an inverted conal heat exchanger would be generally in the shape of a circle.

It will be observed that an inverted frusta-pyramidal shape will naturally have a larger exposed surface area (i.e., more heat-conductive medium will be carried in each rung) than would a conal heat exchanger of a similar size. For example, if a conal-type heat exchanger has a diameter of "D" for any given rung, the perimeter of that rung will be $\pi \times D$. In contrast, the perimeter of a similar sized heat exchanger of the preferred frusta-pyramidal shape would be $4 \times D$. Given that the inner diameter of the pipes would be similar, it can be easily understood that the exposed surface area and the amount of heat-conductive medium carried in the frusta-pyramidal shape would be greater than that for the conal shape.

In order to balance the considerations of flow rate and microwave penetration, and exchange size, pipes with an inner diameter of ½" to 1" should be used. In an embodiment tested by the inventor pipes with an inner diameter of ¾" and an outer diameter of 1" were used. In any event, it is preferred that the inner diameter of the first pipe 106 and the second pipe 104 be the same as that for inlet pipe 100 (i.e., if pipe 100 is 1" then pipes 104 and 106 should each be 1").

It should be understood that larger inner diameter pipes will also perform but may be less efficient. Larger pipes will also increase the overall size of the microwave heat exchanger. The matching of pipe diameters, combined with the split media flow path serves to reduce or eliminate the internal shadow effect and to increase energy absorption within each conduit.

The described construction will give the heat exchanger an inverted, frusta-pyramidal shape. In one embodiment tested by the inventors, the heat exchanger was approximately 10¾" from base to base. The broader base formed a 13"×13" rectangle, and each side inclined toward the narrower base at 30°. It is preferred that the heat exchanger be as large as the microwave source and enclosure will allow. Almost any dimension will allow for some heating. It should be understood that an inverted, truncated frusta-conal shape will also function.

The piping used in the heat exchanger will be dependent on the application. A table of piping materials and appropriate operating temperature and pressure ranges may be seen below.

| Piping Material | Temp. Range | Max. Pressure |
|---|---|---|
| Fiberglass resin with glass fiber reinforcements, resin has high content of silicon | Ambient to 225° F. | 230 PSI |
| Glass (Corning Ware ® type) | Ambient to 550° F. | *Open vented circulating system |
| CPVC$^R$ | Ambient to 170° F. | 100 PSI |
| Ceramic | Ambient to 700° F. | *Open vented circulating system |
| PVC | Ambient to 135° F. | 75 PSI |

*Open vented system means, in this case, that the system will utilize an expansion tank that is vented to atmosphere to maintain an equal barometric pressure within the system and allow for heat expansion and cooling contraction of the fluids in said system.

The choice of heat conductive medium will be largely determined by application. For example, in a hot water heating environment the water to be heated is also, preferably, the heat conductive medium. Water may also be the preferred medium in many residential heating and cooling applications. For high temperature applications (i.e., 200°–700° F.), a heat conductive medium such as Dow-Therm ®, available from the Dow Chemical Company, may be used. SynTherm 44, available from Temperature Products Incorporated, may also be used in this case.

Figure 5:
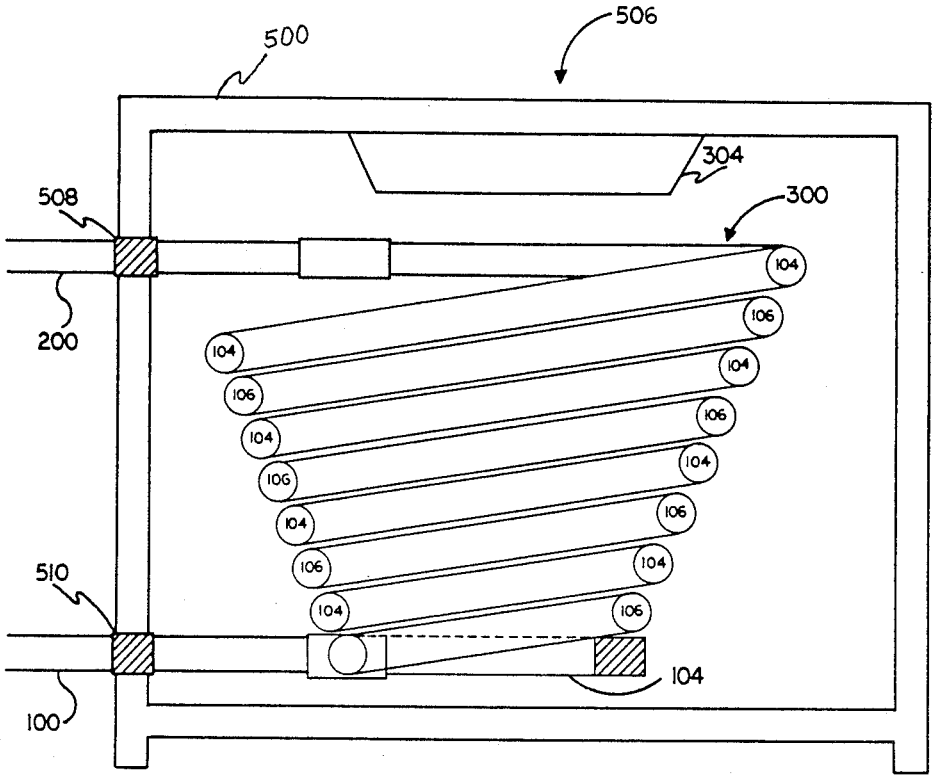
FIG. 5 is a view of the frusta-pyramidal heat exchanger placed within a modified, conventional microwave oven.

In order to use the inventive heat exchanger, it must be placed with its broader base 306 facing a microwave source 302. Referring to FIG. 5, the heat exchanger 300 is shown installed within a conventional microwave oven 500 with the broad base of the heat exchanger 300 facing and parallel to the magnetron 502. (This heat exchanger/microwave assembly is generally referred to by reference numeral 506.) In order to install the heat exchanger 300 into conventional microwave oven 500, two holes, 508 and 510, must be drilled through the side of the oven. The inlet pipe 100 and outlet pipe 200 must be passed through the holes and the unit resealed. The pipes 100 and 200 must be sealed to the oven at the holes 508,510 in such a manner as to prevent or minimize leakage. Such sealing techniques are well known to those skilled in the art.

III. Residential/Commercial Hot Water Heating Embodiment

Figure 6:
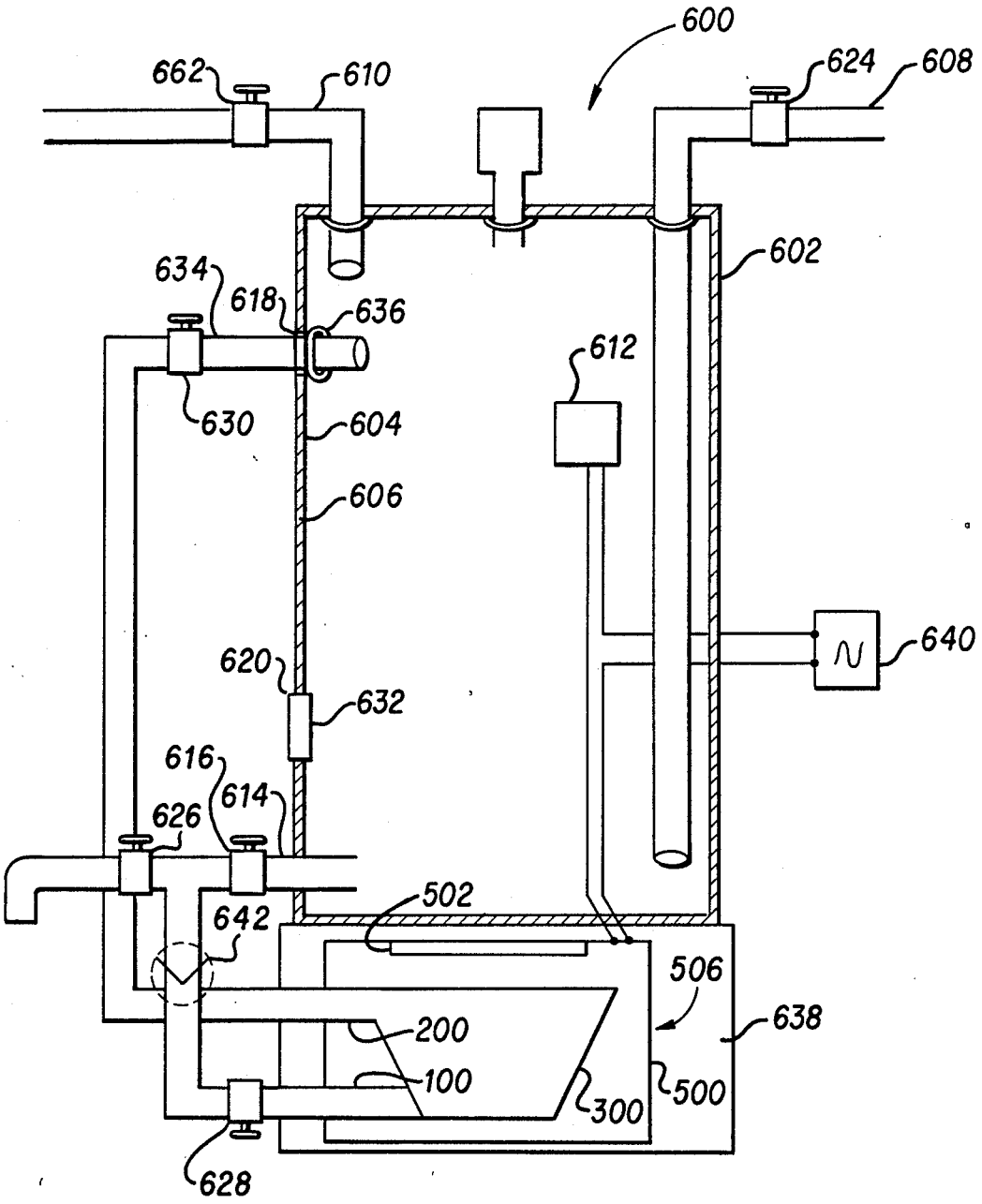
FIG. 6 shows the frusta-pyramidal heat exchanger used in conjunction with a modified conventional hot-water heating system.

Referring to FIG. 6, the inventive heat exchanger is shown as part of a residential hot water heating device.

A conventional hot-water tank 600 is shown with its outer metal wall 602, an inner tank 604, and insulation 606. The cold water supply enters the hot-water tank 600 by passing through the cold water supply pipe 608. Hot water exits the tank through the hot water service pipe 610. A thermostat 612, a drainpipe 614, and a first service valve 616 on the drainpipe are also shown. Many conventional hot-water tanks also have openings such as shown by reference numerals 618 and 620 for the purpose of securing upper and lower heating elements to the tank. Service valves 622, 624, 626, 628 and 630 are also shown in FIG. 6. During operation of the water heater drain service valve 626 is normally left closed. The remaining valves are normally left open (i.e., water is allowed to flow through them).

In order for the tank to be used with the inventive heat exchanger, the hot water tank's lower orifice 620 is sealed with a plug 632. A return pipe 634 is placed into the upper orifice 618 and sealed with a fitting and seal 636. The heat exchanger/microwave assembly 506 (shown schematically) is placed within a dead space 638 underneath tank 600. Where not provided by the manufacturer, a dead space could be created by lifting the tank above a suitable structural sheet-metal enclosure. As an alternative, the heat exchanger/microwave assembly may be placed alongside the hot water tank.

In operation, the hot water tank 600 is filled with cold water supplied under pressure through the cold water supply pipe 608. When the thermostat 612 senses that the temperature of the water within tank 600 is below its threshold, it turns on the conventional microwave unit 500 by applying power from an A.C. source 640. (The wiring of thermostats is well known to those skilled in the art.) In the preferred embodiment, the system also consists of an optional pump 642 which is similarly turned on by the thermostat 612.

Once the microwave unit 500 and pump 642 (if present) are turned on, cold water is pumped from the hot water tank 600 through the drain pipe 614, the first valve 616, the optional pump 642, the inlet pipe 100 and into the heat exchanger 300. Within the heat exchanger, the flow of the water supply is split into the first and second pipes 106, 104. The water within the heat exchanger 300 is carried up toward the microwave source 502 in a split pattern of broadening perimeter and heated by microwaves as it rises. Hot water from the top of the heat exchanger 300 exits through the outlet pipe 200 and travels through the return pipe 634 into hot-water tank 600. Circulation continues until the thermostat 612 senses that the temperature of the water in the hot water tank 600 has risen above its threshold, at which point power to the microwave unit 500 and optional pump 642 is shut off.

When there is a demand for hot water, it is drawn from the hot water tank 600 through the hot water service pipe 610. It is replaced by cold water which enters the hot-water tank at the bottom through cold water supply pipe 608. When the thermostat 612 senses that the water temperature has again dropped below its threshold level, power to the microwave unit 500 and optional pump 642 is again turned on.

The optional pump 642 may be eliminated from the system. In this case, when the thermostat 612 turns on the microwave unit 500, water is drawn into the heat exchanger 300 by the thermal siphon effect created by the shape of the heat exchanger 300 and the temperature gradient of the water therein.

It should be understood that in the absence of a dead space beneath the hot water tank 600, the heat exchanger/microwave unit assembly 506 may be placed along side the tank and the plumbing routed accordingly.

When desired, the drain valve 626 may be used to drain the tank for servicing in accordance with standard hot water tank maintenance procedures.

IV. Residential/Commercial Heating Embodiments

Figure 7:
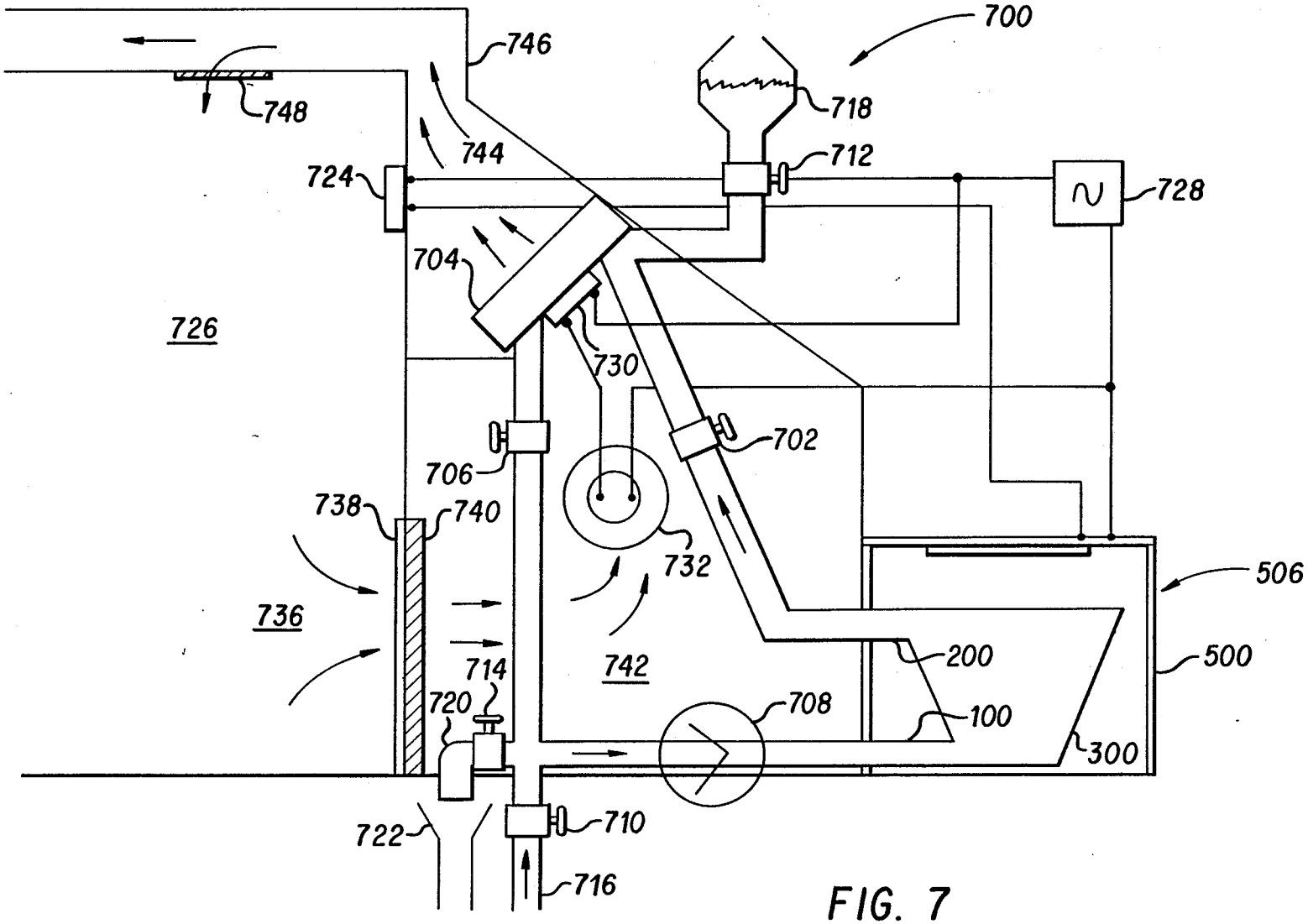
FIG. 7 shows the inverted frusta-pyramidal heat exchanger used in conjunction with a residential/commercial heating system.

Referring to FIG. 7, the inventive heat exchanger is shown as part of a forced hot-air heating system 700. The heat exchanger 300 is placed within a conventional microwave unit 500 to form the heat exchanger/microwave assembly 506 as has been previously described. The heat-conducting medium, preferably water in this case, travels through the flow path defined by the heat exchanger 300, outlet pipe 200, first flow path valve 702, heating coil 704, second flow path valve 706, optional motor driven pump 708, and the inlet pipe 100. The system may be initially filled by opening the cold water supply valve 710, closing the drain valve 714, and allowing water to flow in from the cold water inlet pipe 716. In order to fill the system, the expansion tank shutoff valve 712, (which leads to the vented fluid expansion tank 718), must be open, as well as the first and second flow path valves 702, 706. The system is filled until fluid enters the fluid expansion tank 718 at which point the inlet valve 710 is shut off. In operation, the valves remain as they were during filling except that the cold water supply valve 710, is closed.

The fluid expansion tank 718 allows for fluid expansion and contraction during operation and shutoff periods of the system. A shutoff valve 712 is provided for servicing of the expansion tank. As can be seen from FIG. 7, the fluid expansion tank 718 should preferably attach to the system at its highest point of flow. The first and second flow path valves 702, 706 are used for flow control or isolation of the system. A drain valve 714, drain pipe 720 and a facility drain are used to drain down the system for servicing.

In operation, the room thermostat 724 senses the temperature of the area to be heated 726. When the temperature at the room thermostat 724 falls below a predetermined threshold, power from the AC source 728 is applied to the microwave unit 500 and optional pump 708. In the preferred embodiment, the optional pump 708 is placed at the inlet 100 of the heat exchanger 300. In this case, power from the AC source 728 is supplied to the pump 708 through the operation of the room thermostat 724 at the same time that it is supplied to the microwave unit 500.

The pump 708 and the thermal siphon effect created by the heat exchanger 300 (when heated by microwaves) causes the heat-conductive medium to move along the defined flow path. The heat-conductive medium is heated within the heat exchanger 300 and then passed through a heating coil 704. The heating coil 704 is preferably of a known type made of copper tubing with heat transfer fins (for example, Dayton "A" or "H" type heat exchangers, available from W.W. Grangers Supply Company) or other compatible manufacturer. As the heated water flows through the heating coil 704, the heating coil transfers heat to a heating coil thermostat 730. The heating coil thermostat 730 is installed with a capillary sensing tube attached to the heat exchanger coil 704. When the temperature at the heating coil thermostat 730 rises to a predetermined threshold, power is applied to the centrifugal fan 732. The preferred range for the predetermined threshold (for the heating coil thermostat) is from about 120°-200° F. with 125° being preferred for residential applications. Advantageously, the use of the heating coil thermostat 730 prevents the circulation of unheated air by causing the centrifugal fan not to function until the heating coil attains the proper temperature.

When the centrifugal fan is turned on, cool air 736 is drawn through the intake register 738 and filter 740 by the centrifugal fan 732 into the heating compartment 742. The cool air is then forced through the heating coil 704 by the centrifugal fan 732 and forced in the direction indicated by the arrows 744. As the air passes through the heating coil 704, it is heated. The heated air is then blown into a conventional ductwork system 746 by the centrifugal fan 732 and out the hot-air supply register 748.

The hot air being blown through the hot-air supply register 748, as well as any other number of registers which may be in the area to be heated, causes the temperature in the area to be heated 726 to rise. When the temperature measured at the room thermostat 724 rises above the predetermined threshold, power is cut to the pump 708, and the microwave heating unit 500. The power is continued to the centrifugal fan 732 through the heating coil thermostat 730. The centrifugal fan 732 continues to furnish cool air 736, extracting heat from the heating coil 704, until the lower temperature threshold is attained in the heating coil thermostat 730. The heating coil thermostat 730 then opens the circuit and power is discontinued to the centrifugal fan 732. This ends the heating cycle. If the thermostat 724 senses that the temperature in the area to be heated 726 has again dropped below its threshold, the cycle begins again.

V. Air Conditioning Embodiment

The pyramid heat exchanger may be used in conjunction with a known ammonia, hydrogen adsorption refrigeration system and other systems with similar gases. In this case, a similar unit to the one described for the home heating system is used. Instead of going into a heating coil, heat is provided to the ammonia, hydrogen cooling system (or other system using similar gases) along the heat conductive mediums circulatory path. In this application, DOW-THERM® heat conductive medium, available from the Dow Chemical Company, is preferably used.

VI. Conclusion

Many modifications and improvements to the preferred embodiments will now occur to those skilled in the art. In particular, the shape of the heat exchanger may be changed so as to form an inverted three sided pyramid or so as to form an inverted cone. Also, one may split the water flow into more than two paths. For example, the flow paths, may be split so as to climb as triplet or quadruplet. It may also be seen that the inverted, truncated heat exchanger may be used in many other heating, drying and cooling applications. Therefore, while preferred embodiments of the present invention have been described, these should not be taken as a limitation of the present invention, but only as exemplary thereof; the present invention is to be limited only by the following claims.

What I claim is:

1. A heat exchanger for use with a microwave source comprising:

a microwave—transparent conduit having an inlet opening at one end and an outlet opening at another end, said conduit being shaped so as to form a three dimensional path of widening perimeter from said inlet to said outlet openings, supply means connected to said inlet opening for channeling a heat conductive medium into said inlet opening, whereby the heat conductive medium may be heated by said microwave source, and exit said outlet opening.

2. The heat exchanger of claim 1, wherein said three dimensional path of widening perimeter is in the shape of an inverted conal frustum.

3. The heat exchanger of claim 1, wherein said three dimensional path of widening perimeter is in the shape of an inverted pyramidal frustum.

4. The heat exchanger of claim 3 wherein said three dimensional path of widening perimeter climbs at an angle of between 15 and 75 degrees from horizontal.

5. A microwave heat exchanger comprising;

an inlet;

a first pipe connected to said inlet so as to form a first flow path;

a second pipe connected to said inlet so as to form a second flow path;

an outlet connected to said first and second pipes;

wherein said first and second pipes are disposed between said inlet and said outlet so as to form the general shape of an inverted frustum.

6. The apparatus of claim 5 wherein said frustum is pyramidal.

7. The apparatus of claim 5 wherein said frustum is conal.

8. A method of microwave sourced heat exchange comprising the steps of:

providing a microwave absorbing heat conductive medium;

causing a portion of said medium to flow in a first, spiral flow path of increasing perimeter toward a microwave source;

causing a remaining portion of said medium to flow in a second spiral flow path of increasing perimeter toward said microwave source;

combining said first and second spiral flow paths into a single outlet flow path;

heating said medium with microwaves from said microwave source.

9. The method of claim 8, wherein said first and second spiral flow paths form a frustum shaped cavity.

10. The method of claim 9, wherein said frustum is a pyramidal frustrum.

11. The method of claim 9, wherein said frustum is a conal frustum.

12. A hot water heating device comprising:

a hot-water tank;

an inverted frustum shape heat exchanger having a microwave source positioned at its broad end;

said inverted frustum shape heat exchanger having a microwave-transparent conduit with an inlet opening at one end and an outlet opening at another end, said conduit being shaped so as to form a three-dimensional path of widening perimeter from said inlet to said outlet openings;

said microwave source for applying microwaves to said heat exchanger;

means for supplying cold water from said tank to said heat exchanger;

means responsive to water temperature in said tank for causing said microwave source to supply microwaves to said heat exchanger;

means for returning heated water from said heat exchanger to said tank;

means for providing water to said tank;

means for distributing heated water from said tank.

13. The hot water heating device of claim 12, wherein said means for providing water to said heat exchanger comprises a motor.

14. A forced hot air heating system comprising:

an inverted frustum shaped heat exchanger having a microwave source positioned at its broad end;

said microwave source for providing microwaves to said heat exchanger;

means for causing said microwave source to provide microwaves to said microwave heat exchanger responsive to a room's temperature;

a heating coil;

a circular flow path between said heating coil and said heat exchanger;

a heat conductive medium within said circular flow path;

means for causing said heat conductive medium to circulate within said circular flow path;

means responsive to said heating coil's temperature for causing air to be drawn in from said room and forced through said heating coil, whereby said air is heated;

means for returning the said heated air to said room.

15. The system of claim 14, further comprising a fluid expansion tank disposed at said circular flow path's highest point of flow.

* * * * *